US010730095B2

(12) United States Patent
Kraft et al.

(10) Patent No.: US 10,730,095 B2
(45) Date of Patent: Aug. 4, 2020

(54) MULTIPLE TOOL

(71) Applicant: PASS Stanztechnik AG, Creußen (DE)

(72) Inventors: Stefan Kraft, Schnabelwaid (DE); Andreas Deuerlein, Egloffstein (DE)

(73) Assignee: PASS Stanztechnik AG, Creussen (DE)

( * ) Notice: Subject to any disclaimer, the term of this patent is extended or adjusted under 35 U.S.C. 154(b) by 0 days.

(21) Appl. No.: 16/120,380

(22) Filed: Sep. 3, 2018

(65) Prior Publication Data

US 2019/0070653 A1 Mar. 7, 2019

(30) Foreign Application Priority Data

Sep. 4, 2017 (DE) ..... 10 2017 215 422

(51) Int. Cl.
*B21D 28/12* (2006.01)
*B21D 37/18* (2006.01)

(52) U.S. Cl.
CPC ..... *B21D 28/125* (2013.01); *B21D 28/12* (2013.01); *B21D 37/18* (2013.01)

(58) Field of Classification Search
CPC ..... B21D 28/125; B21D 28/12; B21D 37/18; B23G 3/005
See application file for complete search history.

(56) References Cited

U.S. PATENT DOCUMENTS 5,048,385 A * 9/1991 Eckert ..... B21D 28/12 83/34
8,881,571 B2 11/2014 Straka
2010/0229701 A1* 9/2010 Thielges ..... B21D 22/08 83/13
2011/0107888 A1* 5/2011 Thielges ..... B21D 28/005 83/139
2011/0119881 A1* 5/2011 Lee ..... B21D 28/12 29/50
2013/0133497 A1 5/2013 Kraft
2016/0101457 A1* 4/2016 Meneghetti ..... B21D 28/125 72/333
2017/0209912 A1* 7/2017 Meneghetti ..... B21D 28/246
2017/0239739 A1 8/2017 Kraft

FOREIGN PATENT DOCUMENTS

DE 4411121 C1 3/1995
DE 602005002676 11/2007
EP 2596878 B1 4/2016
WO 2016023794 A1 2/2016

* cited by examiner

*Primary Examiner* — Omar Flores Sanchez
(74) *Attorney, Agent, or Firm* — Smartpat PLC

(57) ABSTRACT

A multiple tool for a punch device, in particular a turret punch press, comprising a punching tool magazine with a guide body and a plurality of punching tools guided in the guide body and a driving mechanism mounted rotatably in relation to the punching tool magazine, the driving mechanism comprising a tool head, which is displaceable relative to the guide body in the direction of a tool longitudinal axis, and a driving shaft, which is attached to the tool head for driving an active punching tool, the tool head having a ram engagement portion with a positive fit profile, which is non-rotationally symmetric to the tool longitudinal axis, to transmit a rotational movement from a ram of the punch device to the tool head.

15 Claims, 7 Drawing Sheets

MULTIPLE TOOL

CROSS-REFERENCE TO RELATED APPLICATION

This application claims the priority of German Patent Application, Serial No. 10 2017 215 422.5, filed Sep. 9, 2017, pursuant to 35 U.S.C. 119(a)-(d), the content of which is incorporated herein by reference in its entirety as if fully set forth herein.

TECHNICAL FIELD

The invention relates to a multiple tool for a punch device, in particular for a turret punch press.

BACKGROUND

A multiple tool for a punch device is known from EP 2 596 878 A2. The multiple tool comprises a punching tool magazine with a guide body configured to guide a plurality of punching tools and a driving body connected to a driving head, the driving body being configured to drive an active punching tool. The multiple tool is connected to a selection drive of the punch device to select the active punching tool. The multiple tool further comprises a mechanical punch length inspection device.

A multiple tool configured to receive a plurality of thread cutters is known from WO 2016/023794 A1. The plurality of thread cutters are arranged in a thread cutter magazine. Selecting an active thread cutter is carried out by rotatably driving a tool head by means of an actuating ram. For this purpose, the tool head has a non-rotationally symmetric receiving groove.

Multiple tools of this type are further known from U.S. Pat. No. 8,881,571 B2, from DE 60 2005 002 676 T2, and from DE 44 11 121 C1.

SUMMARY

An object of the present invention is to expand the possibilities of using a multiple tool, in particular for non-driven base stations of a punch device, and to reduce its dimensions, in particular along a punching direction.

It was found according to the invention that a multiple tool with a ram engagement portion, which has a non-rotationally symmetric positive fit profile relative to the tool longitudinal axis, can be used particularly flexibly and can be manufactured with particularly compact dimensions. The ram engagement portion allows a rotational movement to be transmitted from the punch device, in particular from a ram of the punch device, to the tool head. Preferably, the ram engagement portion is configured as a blind hole extending in the punching direction. The ram is thus capable of transmitting a punching force to the tool head in the punching direction, and is easily removable from the ram engagement portion counter to the punching direction. The positive fit profile of the ram engagement portion can be configured as one side of a tongue/groove connection or of a pin connection or of a spur gearing. Preferably, the positive fit profile has at least one radial groove.

The multiple tool for the punch device comprises the punching tool magazine and the driving mechanism, which is mounted rotatably in relation to the punching tool magazine. The driving shaft attached to the tool head can be displaceable relative to the guide body of the punching tool magazine in the direction of the tool longitudinal axis. The active punching tool is drivable via the driving shaft. In order to drive the active punching tool, the driving shaft can have a driving foot the cross-section of which is configured such that the driving foot interacts only with the punching tool that is active at that time. The guide body can be provided with a respective stripper member for each punching tool. Advantageously, this results in that the active punching tool is displaceable relative to the guide body, and that a workpiece can be held by means of the stripper members when the active punching tool is restored to its initial position.

The active punching tool can be selected via the drive mechanism of the tool head. Advantageously, the driving force transmitted via the ram engagement portion results in that additional transmission members engaging a drive component of the punch device in a direction radial to the tool longitudinal axis are unnecessary. On the one hand, this significantly reduces the necessary installation space both in the radial and in the axial directions while on the other hand allowing the multiple tool according to the invention to be operated on a base station of a punch device, which is in particular not driven.

The punching tool magazine preferably comprises at least two, in particular at least three, in particular at least four, in particular at least six, in particular at least eight, in particular at least sixteen punching tools, which are guided in the guide body. It is conceivable to arrange locking pressure pieces between the guide body and the driving mechanism allowing the driving mechanism to be locked releasably relative to the punching tool magazine. Said locking pressure pieces allow the driving mechanism to be locked reversibly relative to the punching tool magazine in particular rotational positions. The tool head can be releasably connected to the driving shaft, in particular by means of a positive or a non-positive connection. Advantageously, this results in a particularly simple mounting of the multiple tool.

A multiple tool with an aligning means configured to interact with the ram ensuring a coaxial arrangement of a ram rotational axis to the tool longitudinal axis, ensures a particularly rugged operation and allows a workpiece to be machined in a particularly precise manner. The aligning means can be configured such as to form a surface-to-surface contact and/or a line contact with the ram. For this purpose, the aligning means may have at least one, in particular at least two, in particular at least three aligning members. The at least one aligning member can be configured in the manner of an aligning bolt and/or of an aligning web. The aligning member configured in the manner of an aligning web may have a contact surface, which is at least partly concentric to the tool longitudinal axis and allows interaction with the ram. Advantageously, the aligning means ensures a coaxial arrangement of the ram rotational axis relative to the tool longitudinal axis, which helps to achieve a precise workpiece machining and a rugged operation of the multiple tool when, in order to bring about the rotational movement, a force is transmitted to the tool head at a distance from the tool longitudinal axis, which results in a corresponding eccentric transverse force.

A multiple tool comprising a centring means providing some offset tolerance when connecting the ram to the ram engagement portion, is operable in a particularly reliable manner and shows little wear. Preferably, the centring means is configured as a centring chamfer in particular having an angle relative to the tool longitudinal axis of at most 45°, in particular at most 40°, in particular at most 25°. The centring means is preferably arranged in the region of the non-rotationally symmetric positive fit profile and/or in the region of the aligning means. Advantageously this enables the ram to engage the ram engagement portion of the tool head in a particularly secure and reliable manner.

A multiple tool comprising a pressing surface configured to transmit a pressing force from the ram to the tool head and a positive fit profile, which protrudes beyond the pressing surface in a direction counter to the punching direction, ensures a particularly compact arrangement of a plurality of tools in the punch device. The pressing surface is preferably configured as plane surface. The pressing surface may overlap with the tool longitudinal axis when seen in a plan view. Preferably, the pressing surface is surrounded by the positive fit profile and/or the aligning means at least partly, in particular completely. The ram may therefore have a particularly compact design in a plane perpendicular to the tool longitudinal axis. This allows a particularly dense arrangement of tools in the plane perpendicular to the tool longitudinal axis.

Arranging the plurality of punching tools, wherein at least two of the plurality of punching tools having a different radial spacing from the tool longitudinal axis, ensures a particularly space-saving arrangement thereof in the multiple tool. Preferably, the plurality of punching tools are arranged around the tool longitudinal axis. The plurality of punching tools can be positioned on circular paths arranged concentrically to the tool longitudinal axis, the circular paths each having a different diameter. Preferably, a first group of punching tools is arranged on an inner circular path while a second group of punching tools is arranged on an outer circular path. The number of punching tools arranged on the inner circular path may correspond to the number of punching tools arranged on the outer circular path. Preferably, the angle relative to the tool longitudinal axis between any two punching tools arranged adjacent to one another in a circumferential direction is always the same. Arranging the punching tools at a radial offset relative to one another allows them to be arranged in the punching tool magazine in a space-saving manner. This allows a greater number of punching tools to be received in a given punching tool magazine.

A magazine driving connection ensures simple accessibility of the punching tool magazine. The magazine driving connection can be configured as a positive and/or a non-positive connection, in particular as a screw connection. The magazine driving connection can be configured as a single screw arranged concentrically to the tool longitudinal axis in such a way as to provide a non-positive connection between the driving mechanism and the punching tool magazine. Preferably, the magazine driving connection is accessible and releasable without having to dismantle the driving mechanism and/or the punching tool magazine via a recess in the tool head. Preferably, the integrity of the driving mechanism is maintained even if the magazine driving connection is released. The driving mechanism can therefore be removed from the punching tool magazine as a whole after releasing the magazine driving connection.

A multiple tool, wherein the driving mechanism has a driving flange, which abuts against the guide body in the punching direction, and that a stripping force means is arranged between the driving flange and the tool head, the stripping force means being configured to apply a force to the tool head, which is oriented counter to a punching direction, ensures an efficient and precise machining of the workpieces. The driving flange can be rigidly connected to the guide body in the punching direction. Preferably, the driving flange is mounted rotatably in the guide body. The pressure pieces can be arranged between the driving flange and the guide body. The driving shaft can be mounted non-rotationally in the driving flange in such a way as to be displaceable along the tool longitudinal axis. The driving shaft is therefore mounted particularly precisely relative to the driving flange and relative to the guide body.

A stripping force means can be arranged between the tool head and the driving flange. Preferably, the stripping force means includes at least one spring member, configured in particular as a rubbery-elastic body or as a flat coil spring or as a helical spring or as a disk spring, in particular as a compression spring or a tension spring. The stripping force means is configured to apply a restoring force to the tool head counter to the punching direction. Preferably, the stripping force means is active between the tool head and the plurality of stripper members. Advantageously, this enables the punching stroke to be carried out at high speeds while ensuring a high-precision machining of the workpieces.

A driving mechanism comprising a selection disk, which is mounted in such a way as to be axially displaceable relative to the driving shaft and is rotatably drivable by the latter, said selection disk being configured to limit a displacement of inactive punching tools counter to the punching direction, ensures a particularly rugged operation with minimized vulnerability to failure. Preferably, the selection disk is mounted to the driving shaft, in particular to a shaft sleeve, in such a way as to be axially displaceable. The displacement of the selection disk relative to the driving shaft can be limited in the punching direction by a retaining ring. The selection disk is capable of limiting the displacement of inactive punching tools in the direction counter to the punching direction. Advantageously, this ensures that when the driving shaft is rotated to select the active punching tool, none of the inactive punching tools collides with the driving foot. The selection disk can be non-rotationally connected to the driving shaft. The selection disk may include a positive fit means, which interacts with the driving foot by forming a positive fit connection therewith in the circumferential direction about the tool longitudinal axis.

A driving mechanism, wherein a driving foot of the driving shaft passes through a selection opening of the selection disk in an axial direction, the driving foot acting on the active punching tool, ensures a compact design and the rugged operation of the multiple tool. The driving foot is capable of passing through the selection disk in a direction parallel to the tool longitudinal axis. For this purpose, the selection disk may be provided with a selection opening. Preferably, a clearance fit is formed between the selection disk and the driving foot, in particular in the edge region of the selection opening. The driving foot passing through the selection disk is capable of transmitting a rotational movement of the driving shaft to the selection disk.

At least one selection spring member which applies a force to the selection disk that is oriented in the punching direction is arranged between the driving shaft and the selection disk. The at least one selection spring member guarantees the rugged operation of the multiple tool. Preferably, the at least one selection spring member is configured as a rubbery-elastic body or as a flat coil spring or as a helical spring or as a disk spring or as a leaf spring, in particular as a compression spring or as a tension spring. Adjacent selection spring members are preferably evenly spaced from one another in the circumferential direction around the tool longitudinal axis. The selection spring members can be arranged on a circular path, which is concentric to the tool longitudinal axis. Advantageously, the at least one selection spring member ensures that the at least one inactive punching tool is displaced, by means of the selection disk, in the punching direction and relative to the driving shaft. The inactive punching tools can therefore be guided in the punching direction in a defined manner, which prevents a collision of the driving foot with the at least one inactive punching tool when the driving shaft is being rotated.

An inspection device for inspection of the punching tools being arranged between the guide body and the plurality of punching tools, allows a simple inspection and maintenance of the multiple tool. The inspection device can be actuable manually. For this purpose, the inspection device can be actuated in the punching direction via a head opening of the guide body. When actuated, the inspection device is configured to move at least one of the punching tools out of the punching tool magazine in the punching direction to such an extent as to allow an in particular visual inspection thereof. When actuating the inspection device, it is conceivable as well that all punching tools are moved out of the punching tool magazine in the punching direction for inspection.

An inspection device having a punch disk mounted in such a way as to be axially displaceable in the guide body, with the plurality of punching tools being mounted in such a way as to be axially displaceable relative to said punch disk, and that the plurality of punching tools each having a punching tool collar interacting with the punch disk in a positively locking manner so as to limit the displaceability of the plurality of punching tools relative to the punch disk in the punching direction, is actuable particularly easily. The plurality of punching tools are capable of passing through the punch disk in the direction of the tool longitudinal axis. Preferably, the plurality of punching tools are guided in the punch disk along the tool longitudinal axis. The punch disk is rigidly connected to the tool head preferably in the direction of the tool longitudinal axis, in particular by means of the magazine driving connection. The displaceability of the punch disk can be limited counter to the punching direction by a magazine screw, which is supported on the guide body. In the punching direction, the displaceability of the plurality of punching tools can be limited relative to the punch disk by means of the respective punching tool collar. Preferably, the respective punching tool collar and the punch disk are configured such that the at least one punching tool does not protrude upwardly beyond the punch disk when the punching tool collar abuts against the punch disk.

An inspection device having at least one inspection spring member, which applies a force to the plurality of punching tools that is oriented counter to the punching direction, is actuable particularly easily. The at least one inspection spring member can be configured as an elastic body or as a flat coil spring or as a helical spring or as a leaf spring or as a disk spring, in particular as a compression spring or as a tension spring. It is conceivable to arrange a plurality of inspection spring members around the tool longitudinal axis in such a way as to be evenly spaced from one another in the circumferential direction. The at least one inspection spring member is preferably arranged between the guide body and the punch disk. The at least one inspection spring member is able to act on the respective punching tool collar of a punching tool via the punch disk.

The at least one inspection spring member having a spring rate, which is between 0.1 N/mm and 5 N/mm, more preferably between 0.2 N/mm and 1.0 N/mm, ensures a particular simple actuation of the inspection device. Advantageously, this allows the inspection device to be actuated manually or with only one finger.

The at least one inspection device being formed with a radial spacing from the tool longitudinal axis, ensures a precise guidance of the punch disk. Preferably, the at least one inspection member is arranged on a circular path, which is concentric to the tool longitudinal axis. This prevents the punch disk from tilting when being actuated.

Further features, advantages and details of the invention emerge from the ensuing description of an exemplary embodiment.

DETAILED DESCRIPTION

Figure 1:
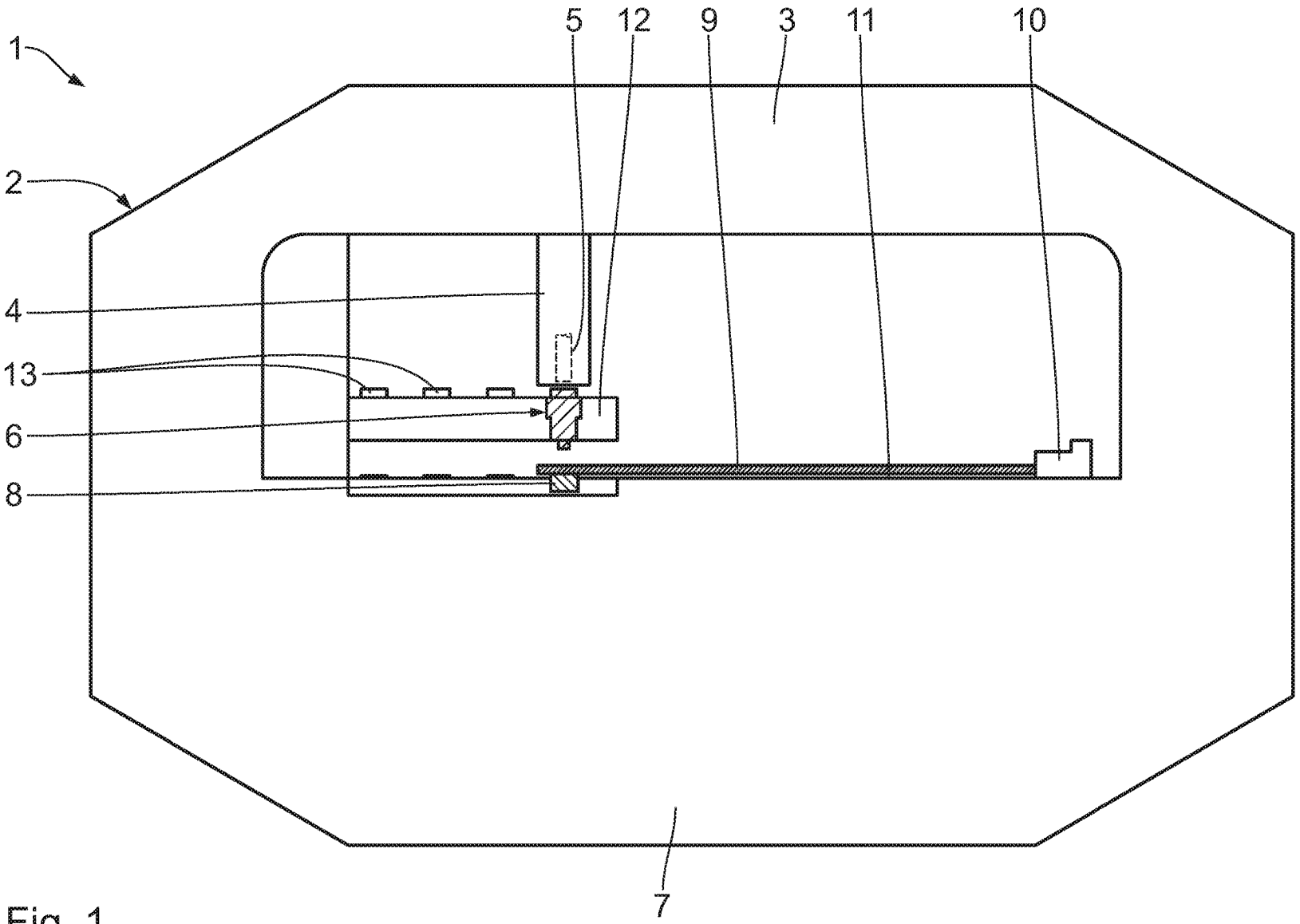
FIG. 1 shows a side view of a schematically shown punch device comprising a multiple tool according to the invention.

A punch device 1 as shown in FIG. 1 comprises a frame structure 2, with an actuating member 4 comprising a ram 5 being attached to the frame upper part 3 thereof. A multiple tool 6 is arranged below the ram 5. A workpiece counter holder 8 is arranged on a frame lower part 7 of the punch device 1. A workpiece 9 is located between the multiple tool 6 and the workpiece counter holder 8. The workpiece 9 can be positioned on a workpiece receptacle 11 of the punch device 1 by means of a positioning drive 10. The multiple tool 6 and the workpiece counter holder 8 interact in the manner of a punch and die. The multiple tool 6 and the workpiece counter holder 8 are arranged on a machine turret 12. Furthermore, additional machining tools 13 are arranged in the machine turret 12. The multiple tool 6 or any other machining tool 13 can be selected by driving the machine turret 12. The workpiece 9 can be a sheet plate, in particular a metal sheet plate.

Figure 2:
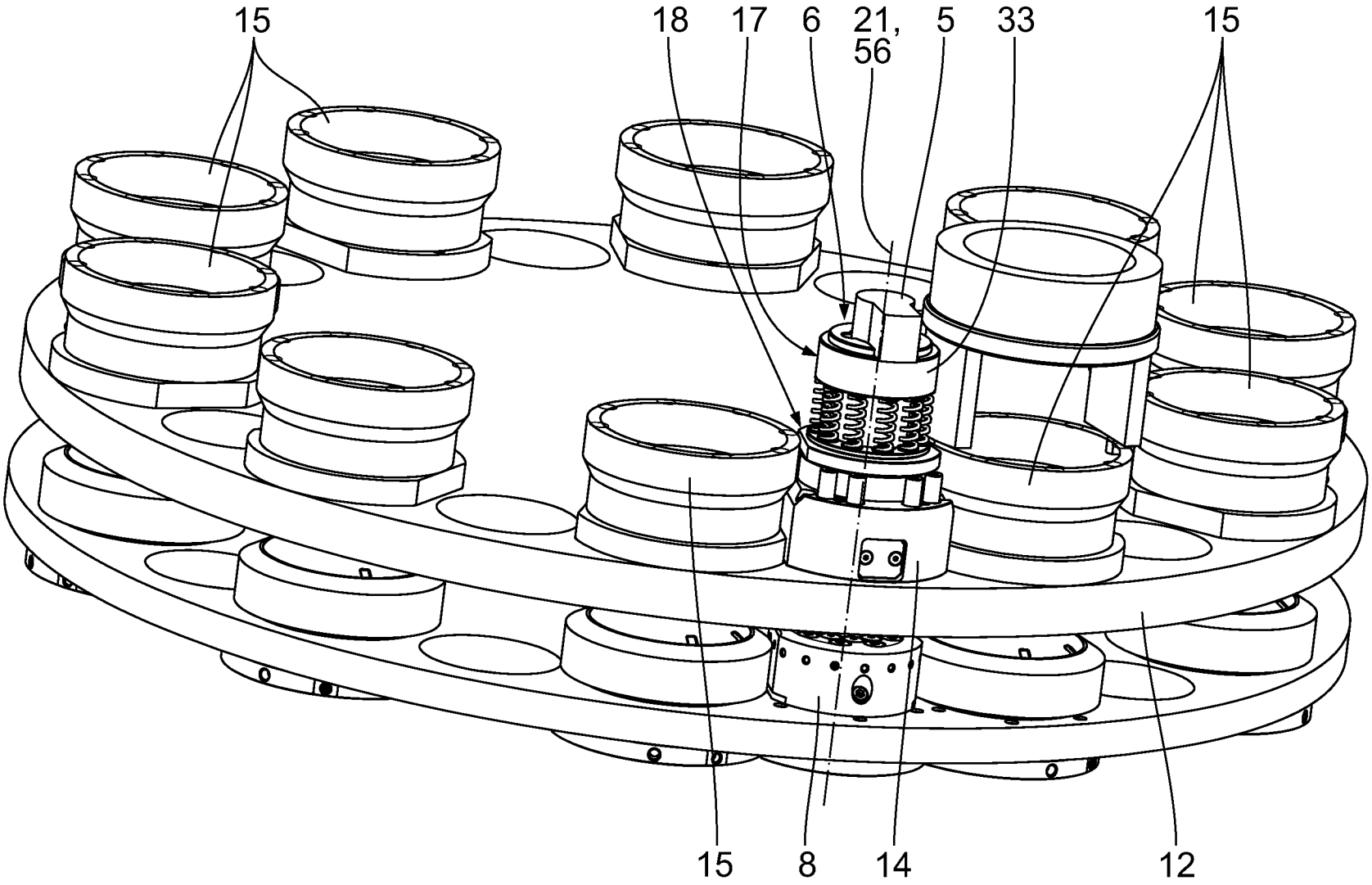
FIG. 2 shows a perspective view of the multiple tool on a base station of a machine turret of the punch device, a tool head of the multiple tool engaging a ram of the punch device.
Figure 3:
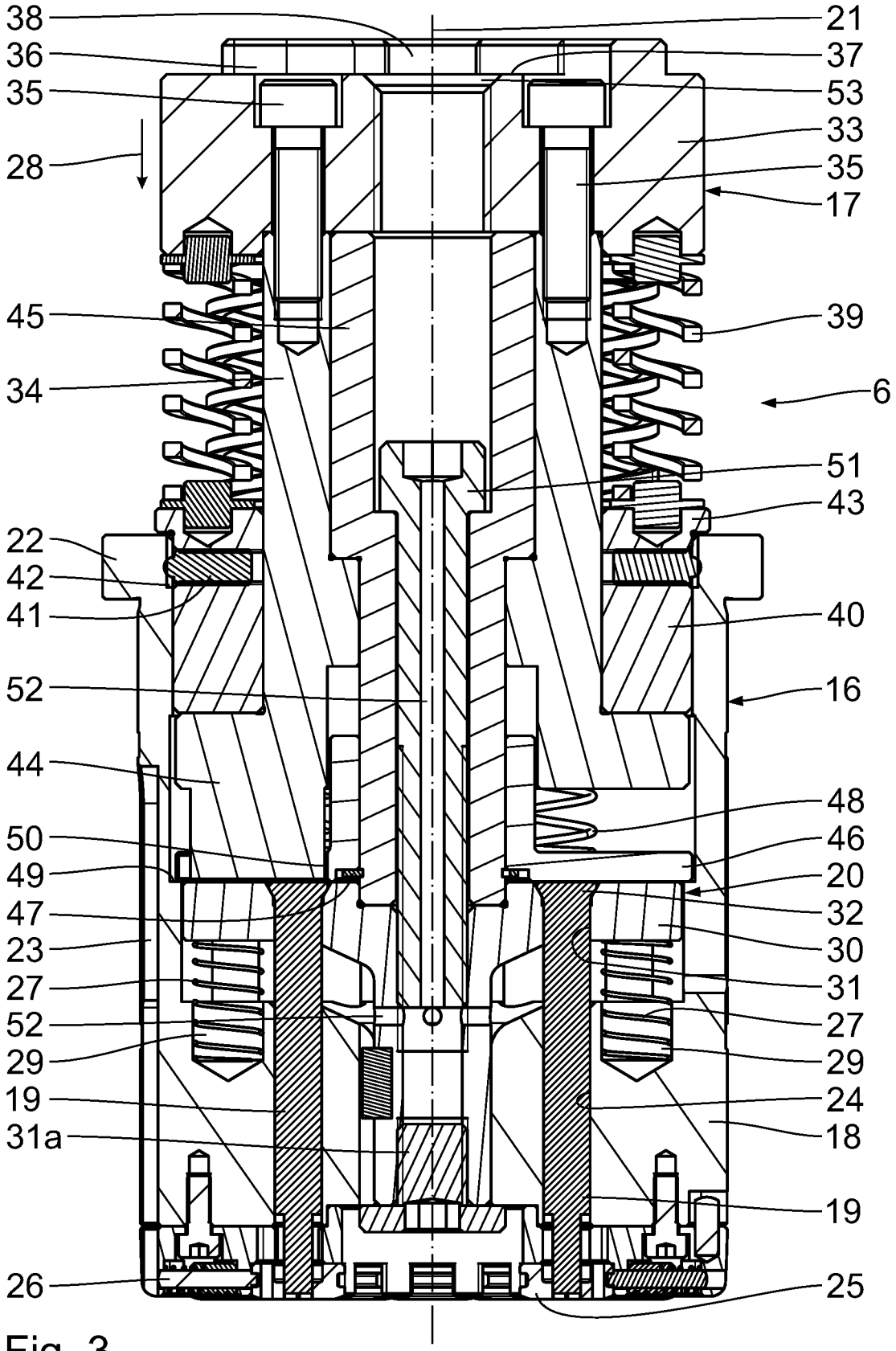
FIG. 3 shows a sectional view of the multiple tool according to FIG. 2 in an initial position.

The machine turret 12 with the multiple tool 6 placed therein is shown in more detail in FIG. 2. The machine turret 12 comprises base stations 14 and indexing stations 15 adapted to receive tools 6, 13. The base stations 14 and the indexing stations 15 are arranged in a circle on the machine turret 12. The indexing stations 15 are rotatably drivable by means of a tool drive (not shown) of the punch device 1. The base stations 14 arranged between the indexing stations 15 are not drivable by means of this tool drive. The multiple tool 6 is arranged on one of the base stations 14.

The multiple tool 6 is shown in more detail in FIGS. 3 to 6. The multiple tool 6 comprises a punching tool magazine 16 and a driving mechanism 17 mounted rotatably in relation thereto.

The punching tool magazine 16 includes a guide body 18, a plurality of punching tools 19 and an inspection device 20 acting between the guide body 18 and the plurality of punching tools 19. In order to fix the guide body 18 in the direction of a tool longitudinal axis 21 of the multiple tool 6, said guide body 18 is provided with a fixing flange 22. A tongue/groove connection between the machine turret 12 and the guide body 18 ensures that the guide body 18 is secured to the machine turret 12 around the tool longitudinal axis 21. For this purpose, the guide body 18 is provided with a fixing groove 23. The driving mechanism 17 is mounted rotatably in the guide body 18.

The punching tools 19 are mounted in the punching tool guides 24 of the guide body 18 in such a way as to be displaceable in the direction of the tool longitudinal axis 21. The punching tool guides 24 are evenly spaced from one another in the circumferential direction relative to the tool longitudinal axis 21. The punching tools 24 each have a different radial spacing from the tool longitudinal axis 21. The punching tool guides 24 are alternately arranged on an inner and an outer circular path when seen in the circumferential direction. The inner and the outer circular path are concentric to the tool longitudinal axis 21.

Stripper members 25 are arranged at the bottom of the guide body 18 to strip off the workpiece 9 when the punching tools 9 revert to their initial positions. The inner stripper members 25 arranged radially to the tool longitudinal axis 21 are fixed to the guide body 18 by means of stripper holders 26. The radially outer stripper members 25 are fastened in the direction of the tool longitudinal axis 21 by means of radial grooves (not shown) and secured by means of pressure pieces to prevent a displacement in the axial direction.

The inspection device 20 is arranged in the guide body 18. The inspection device 20 includes a plurality of inspection spring members 27, which are configured to apply a force to the plurality of punching tools 19 in a direction counter to a punching direction 28. The inspection spring members 27 are oriented parallel to the tool longitudinal axis 21 and arranged radially in the region of the outer punching tool guides 24. The inspection spring members 27 are configured as helical compression springs and arranged in inspection spring boreholes 29 of the guide body 18.

The inspection spring members 27 are active between the guide body 18 and a punch disk 30. The punch disk 30 is provided with a magazine screw 31*a*. The punching tools 19 pass through the punch disk 30 in disk boreholes 31 and are mounted displaceably in relation to the punch disk 30 in the direction of the tool longitudinal axis 21. The magazine screw 31*a* is supported on the guide body 18 counter to the punching direction 28 and limits the displaceability of the punch disk 30 in the upward direction.

The punching tools 19 have a punching tool collar 32. The punching tool collar 32 is arranged above the disk boreholes 31 in such a way that the punch disk 30 is positively connected with the punching tools 19 counter to the punching direction 28. The spring force provided by the inspection spring members 27 therefore acts on the punching tools 19 via the punch disk 30. The inspection spring members 27 have a spring rate of 0.5 N/mm. The punch disk 30 mounted in the guide body 18 is displaceable along the tool longitudinal axis 21 due to a variable length of the inspection spring members 27 of 10 mm.

The driving mechanism 17 comprises a tool head 33, which is displaceable relative to the guide body 18 along the tool longitudinal axis 21, and a driving shaft 34 attached thereto. The tool head 33 is rigidly connected to the driving shaft 34 by means of screw members 35.

The tool head 33 has a ram engagement portion 36 allowing the tool head 33 to be actuated by means of the ram 5 of the punch device 1. The ram 5 interacts with the multiple tool 6 in the punching direction 28 via an engagement bottom 37 of the ram engagement portion 36. The ram engagement portion 36 has a positive fit profile 38, which is non-rotationally symmetric relative to the tool longitudinal axis 21, in order to transmit a rotational movement from the ram 5 to the multiple tool 6. The positive fit profile 38 is configured as a radial groove.

The tool head 33 is supported, via a stripping force means 39, on a driving flange 40 in the direction of the tool longitudinal axis 21. The stripping force means 39 is configured in the manner of helical compression springs. The stripping force means 39 is configured to apply a restoring force to the tool head 33 counter to the punching direction 28.

The driving flange 40 is mounted rotatably in the guide body 18. In order to releasably lock the driving flange 40 in discrete angular positions relative to the tool longitudinal axis 21, the driving flange 40 has locking pressure pieces 41, which engage locking grooves 42 of the guide body 18. The position of the locking pressure piece 41 relative to the locking grooves 42 in the circumferential direction about the tool longitudinal axis 21 is configured such that when selecting an active punching tool 19, the driving mechanism 17 is locked relative to the punching tool magazine 16. The driving flange 40 has a driving flange collar 43. The driving flange collar 43 forms a stop opposite the guide body 18 when seen in the punching direction 28. The driving flange 40 is non-rotationally connected to the driving shaft 34.

The driving shaft 34 is mounted displaceably in relation to the driving flange 40 in the direction of the tool longitudinal axis 21. The driving shaft 34 has a driving foot 44. The driving foot 44 is configured to transmit punching forces to a single active punching tool 19 and to the punch disk 30. The active cross-section of the driving foot 44 extends across the radial distance of the inner and outer punching tools 19 and has an extension in the circumferential direction, which allows actuation of a single punching tool 19.

The driving shaft 34 surrounds a shaft sleeve 45. A selection disk 46 is mounted to the shaft sleeve 45 in such a way as to be rotatable about the tool longitudinal axis 21. The selection disk 46 is capable of moving relative to the shaft sleeve 45 in the direction of the tool longitudinal axis 21 between a step of the driving shaft 34 and a retaining ring 47 mounted to the shaft sleeve 45. Selection spring members 48 are arranged between the driving shaft 34 and the selection disk 46. The selection spring members 48 are configured as helical compression springs and act on the selection disk 46 in the punching direction 28. The displacement of the selection disk 46 is limited in the punching direction 28 by a disk stop 49 of the guide body 18.

The selection disk 46 has a selection opening 50. The driving foot 44 acting on an active punching tool passes through the selection opening 50 of the selection disk 46. The remaining inactive punching tools 19 are covered by the selection disk 46 when seen in a plan view. The shaft sleeve 45 is non-positively connected, via a magazine driving connection 51, with the punch disk 30. The magazine driving connection 51 connects the driving mechanism 17 with the punching tool magazine 16.

The magazine driving connection 51 is configured as a hollow screw. A lubricant channel 51 is formed in the magazine driving connection 51. The lubricant channel 52 extends into the punch disk 30. Lubricant can therefore be delivered to the punching tools 19 via a feed opening 53 of the tool opening 33.

Figure 7:
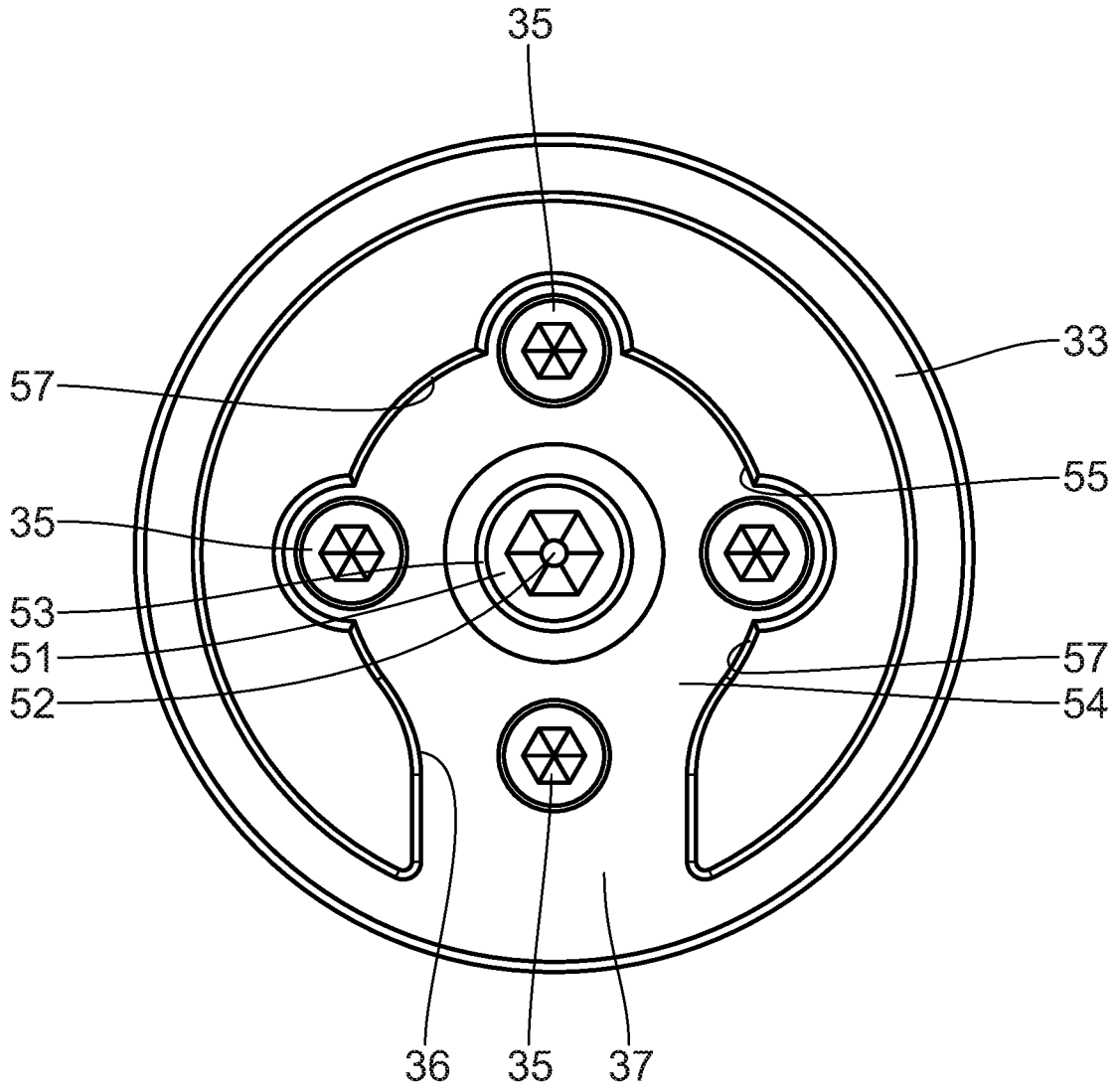
FIG. 7 shows a plan view of the tool head in FIG. 2 with a ram engagement portion, which has a non-rotationally symmetric positive fit profile, a pressing surface, an aligning means and a centring means.

The tool head 33, in particular the ram engagement portion 36, is shown in more detail in FIG. 7. In addition to the positive fit profile 38, the ram engagement portion 36 comprises a pressing surface 54 configured to transmit a pressing force F from the ram 5 to the tool head 33, an aligning means 5, which ensures a coaxial arrangement of a ram rotational axis to the tool longitudinal axis 21, and a centring means 21, which provides some offset tolerance when connecting the ram 5 to the ram engagement portion 36. The pressing surface 54 is configured as a plane contact surface configured to transmit the pressing force F from a front face of the ram 5 to the tool head 33. The positive fit profile 38 protrudes upwardly beyond the pressing surface 54, in particular counter to the punching direction 28.

The aligning means 55 is configured as a hollow cylindrical sector-shaped web. In order to arrange the ram rotational axis 56 coaxially to the tool longitudinal axis 21, the hollow cylindrical sector shaped web extends across a central angle of more than 180°, in particular of more than 240°. The aligning means 55 directly abuts against the positive fit profile 38.

The centring means 57 is configured as a chamfer. The centring means 57 is arranged on an upper edge of the positive fit profile 38 and of the aligning means 55.

The mode of functioning of the multiple tool 6 for the punch device 1 is as follows.

The multiple tool 6 is arranged below the ram 5 of the actuating member 4 by actuating the machine turret 12. The workpiece 9 is positioned, by means of the positioning drive 10, between the multiple tool 6 and the workpiece counter holder 8.

The multiple tool 6 is in an initial position, with the ram 5 being disengaged from the tool head 33. The stripping force means 39 is preloaded between the driving flange collar 43 and the tool head 33. The driving foot 44 of the driving shaft 34 protrudes into the selection opening 50 of the selection disk 46. The selection disk 46 abuts against the disk stop 49. The punch disk 30 is preloaded, by means of the inspection spring members 27, against the selection disk 46. The selection disk 46 is preloaded, by means of the selection spring members 48, in the punching direction 28 against the disk stop 49 and the punch disk 30. The punching tool collars 32 of the punching tools 19 contact the punch disk 30 so the punching tools 19 do not protrude beyond the guide body 18 in the punching direction 28.

The ram 5 is displaced downwardly along the tool longitudinal axis 21, in particular in the punching direction 28. The ram 5 engages the centring means 57 of the ram engagement portion 36. The centring means 57 ensures a guided displacement of the ram 5 in the direction of the engagement bottom 37 while compensating an offset between the ram rotational axis 56 and the tool longitudinal axis 21. When the ram 5 is displaced further in the punching direction 28, the ram 5 engages the positive fit profile 38, the aligning means 55 and the pressing surface 54. The pressing force F is transmitted from the ram 5 to the engagement bottom 37, in particular to the pressing surface 54. The tool head 33 is rotatably driven by the ram 5 in order to select the active punching tool 19. The aligning means 55 ensures the coaxial arrangement of the ram rotational axis 56 to the tool longitudinal axis 21. The rotational movement is transmitted from the ram 5 to the tool head 33 via the non-rotationally symmetric positive fit profile 38. The rotational movement is transmitted from the tool head 33 to the driving shaft 34 and the driving foot 44. The driving foot 44 penetrating the selection opening 50 rotates the selection disk 46 about the tool longitudinal axis 21. In this manner, the driving foot 44 is positioned above the active punching tool 19 while the inactive punching tools 19 are covered by the selection disk 46. The lower side of the driving foot 44 is then coplanar to the lower side of the selection disk 46. The locking pressure pieces 41 engage the locking grooves 42 so as to provide a resistance against a rotation of the driving mechanism 17 relative to the punching tool magazine 16.

Figure 4:
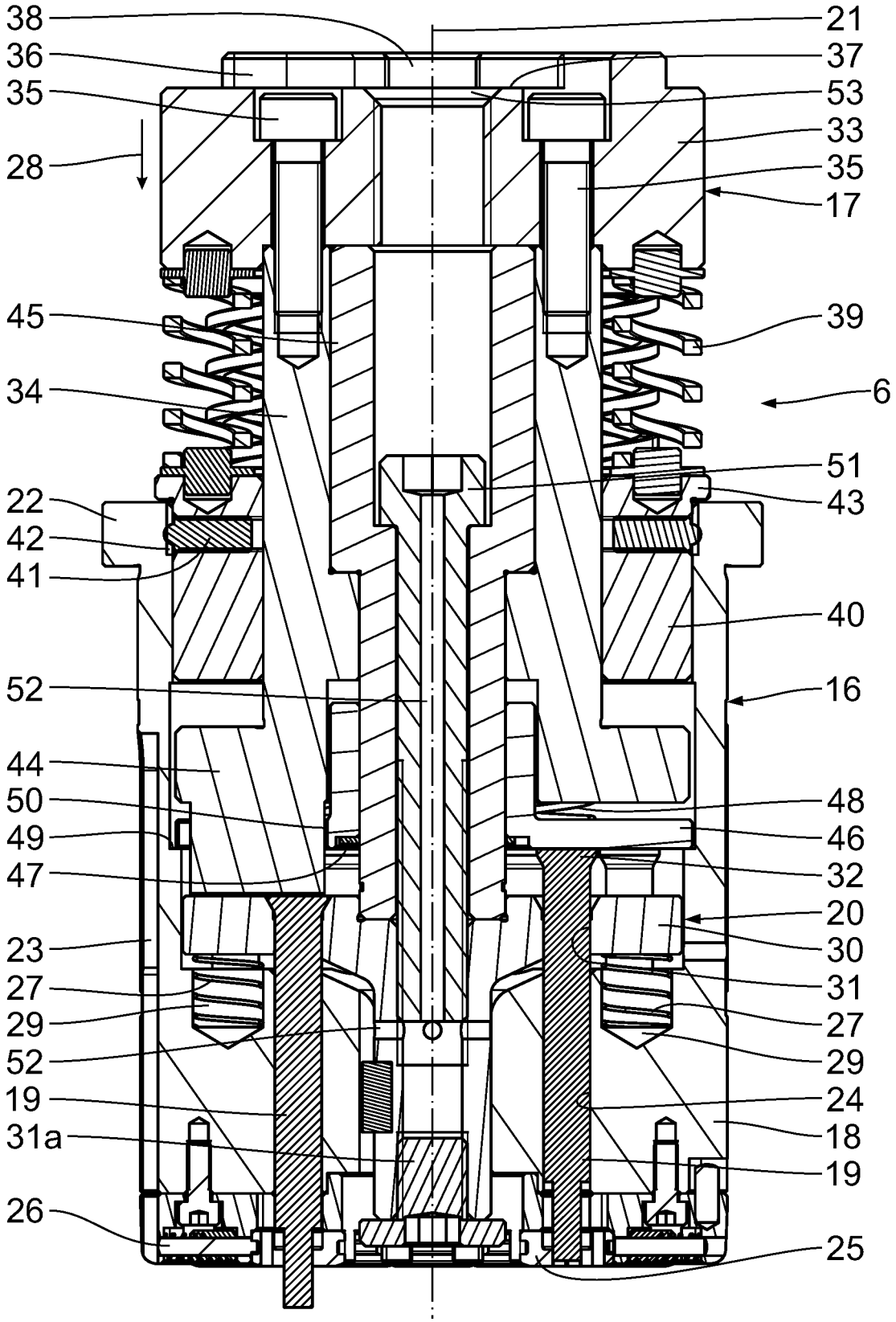
FIG. 4 shows a sectional view of the multiple tool according to FIG. 2 in a cutting position.
Figure 5:
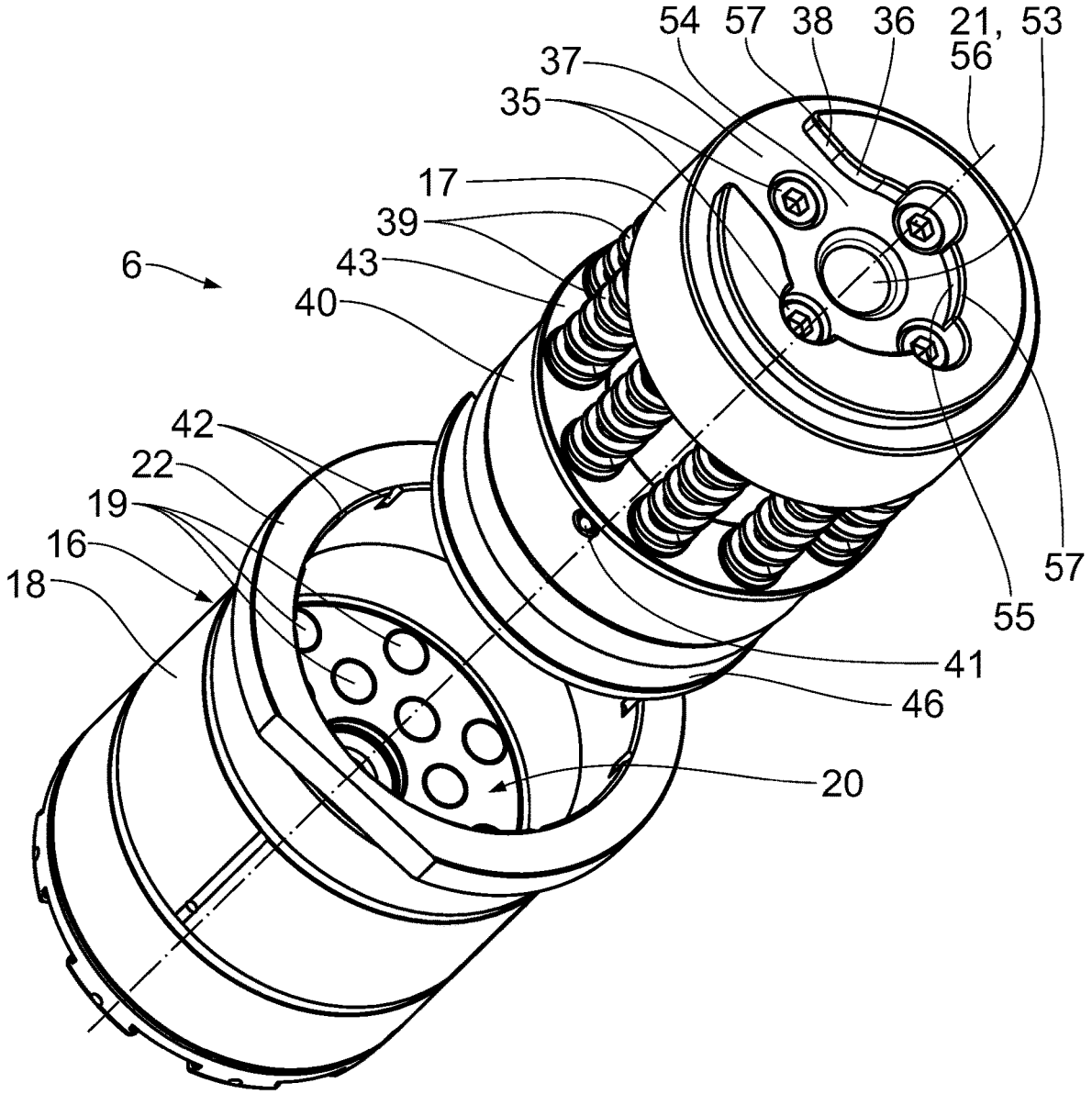
FIG. 5 shows a perspective view of the multiple tool according to FIG. 2 seen obliquely from above with a magazine driving connection being released, with a driving mechanism being shown separately from a punching tool magazine.
Figure 6:
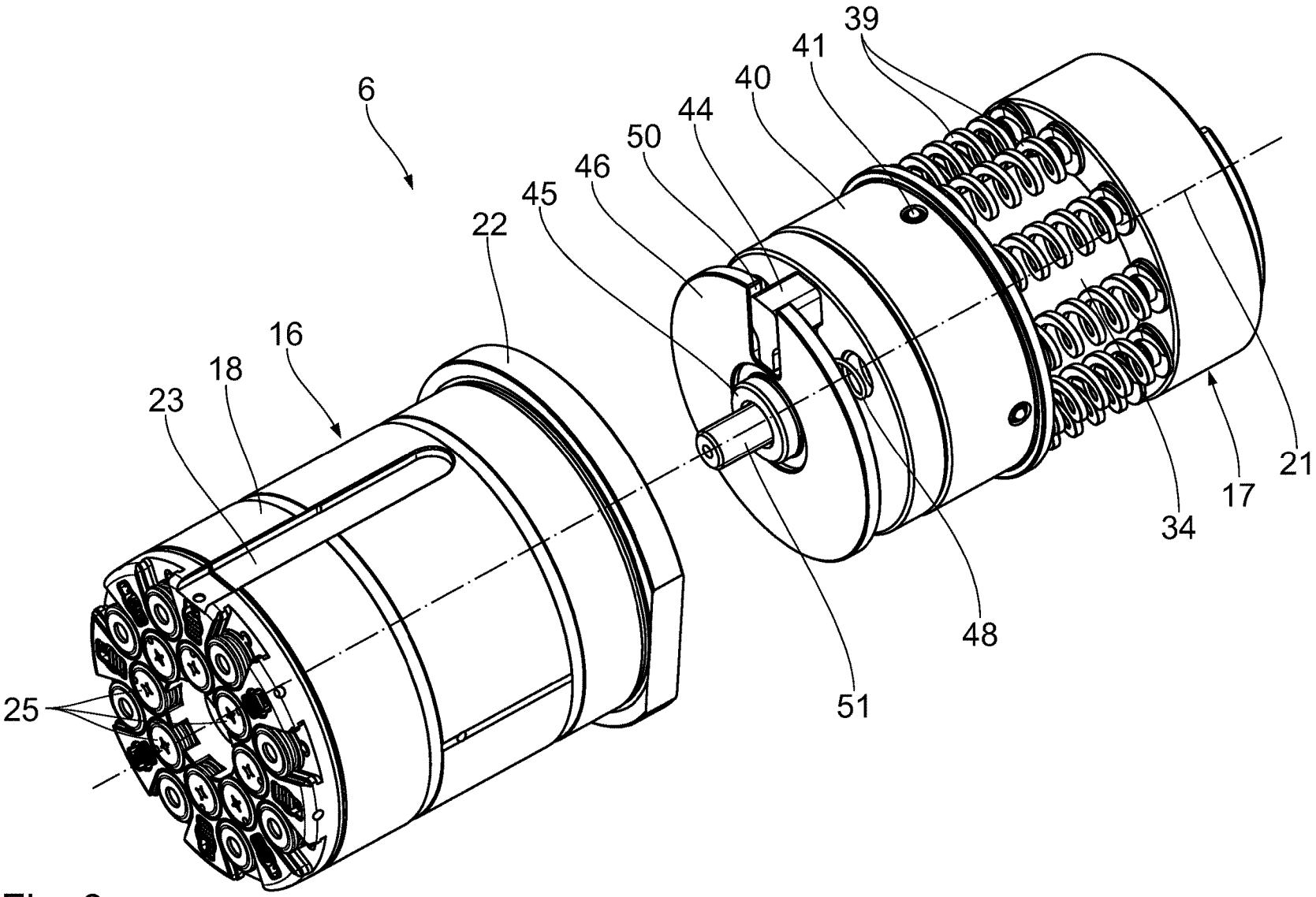
FIG. 6 shows a perspective view of the multiple tool according to FIG. 2 seen obliquely from below with the magazine driving connection being released, with the driving device being shown separately from the punching tool magazine.

By means of the ram 5, the tool head 33 is moved downwardly in the punching direction 28. The tool head 33 acts on the active punching tool 19 and the punch disk 30 via the driving shaft 34 and the driving foot 44. As shown in FIG. 4, the driving foot 44 passes through the selection opening 50, and the active punching tool 19 passes out of the guide body 18, in particular out of the stripper member 25, in the punching direction 28. The active punching tool 19 passes through the workpiece 9 (not shown) and protrudes into the workpiece counter holder 8, which is not shown either. The stripping force means 39 are compressed between the tool head and the driving flange 40 abutting against the guide body 18. The selection spring members 48 are compressed between the driving shaft 34 lowered in the punching direction 28 and the selection disk 46 abutting against the disk stop 49. The punch disk 30 is displaced in the punching direction 28 towards the bottom of the guide body 18, with the inspection spring members 27 arranged therebetween being compressed even more. Via the feed opening 53, the multiple tool 6 is supplied with lubricant, which is delivered to the punching tools 19 via the lubricant channels 52. The multiple tool 6 is in its cutting position.

The ram 5 is moved back counter to the punching direction 28. The stripping force means 39 act on the tool head 33 in an upward direction, in other words counter to the punching direction 28. The tool head 33, the driving shaft 34, the shaft sleeve 45 and the magazine driving connection 51 are displaced upwardly counter to the punching direction 28 together with the punch disk 30 and the punching tools 19. The compressed inspection spring members 27 and the selection spring members 48 act on the punch disk 30 and the driving shaft 34 so as to assist the displacement of the driving mechanism 17 relative to the guide body 18. The stripper members 25 prevent the workpiece 9 from being lifted while the active punching tool 19 is moved back counter to the punching direction 28. The multiple tool 6 is in its initial position.

The invention claimed is:

1. A multiple tool for a punch device, in particular for a turret punch press, comprising a punching tool magazine with a guide body and a plurality of punching tools guided in the guide body, and a driving mechanism mounted rotatably in relation to the punching tool magazine, the driving mechanism comprising a tool head, which is displaceable relative to the guide body in the direction of a tool longitudinal axis, and a driving shaft attached to the tool head in order to drive an active punching tool, wherein the tool head has a ram engagement portion with a positive fit profile, which is non-rotationally symmetric relative to the tool longitudinal axis, in order to transmit a rotational movement from a ram of the punch device to the tool head, wherein the driving mechanism comprises a selection disk, which is rotatably drivable by the driving shaft, said selection disk being configured to limit a displacement of inactive punching tools counter to the punching direction, and wherein a driving foot of the driving shaft passes through a selection opening of the selection disk in an axial direction, the driving foot acting on the active punching tool.

2. The multiple tool as claimed in claim 1, wherein the ram engagement portion has an aligning means configured to interact with the ram, the aligning means ensuring a coaxial arrangement of a ram rotational axis to the tool longitudinal axis.

3. The multiple tool as claimed in claim 1, wherein the ram engagement portion has a centring means providing some offset tolerance when connecting the ram to the ram engagement portion.

4. The multiple tool as claimed in claim 1, wherein the ram engagement portion has a pressing surface configured to transmit a pressing force from the ram to the tool head, the positive fit profile protruding beyond the pressing surface counter to the punching direction.

5. The multiple tool as claimed in claim 1, wherein at least two of the plurality of punching tools have a different radial spacing from the tool longitudinal axis.

6. The multiple tool as claimed in claim 1, wherein the driving mechanism is connected, by means of a magazine driving connection, to the punching tool magazine in the direction of the tool longitudinal axis, said magazine driving connection being configured such as to be accessible and releasable without having to dismantle the driving mechanism and/or the punching tool magazine.

7. The multiple tool as claimed in claim 1, wherein the driving mechanism has a driving flange, which abuts against the guide body in the punching direction, and that a stripping force means is arranged between the driving flange and the tool head, the stripping force means being configured to apply a force to the tool head, which is oriented counter to a punching direction.

8. The multiple tool as claimed in claim 1, wherein the selection disk is mounted in such a way as to be axially displaceable relative to the driving shaft.

9. The multiple tool as claimed in claim 1, wherein between the driving shaft and the selection disk, at least one selection spring member is arranged, which applies a force to the selection disk that is oriented in the punching direction.

10. The multiple tool as claimed in claim 1, wherein an inspection device for inspection of the punching tools is arranged between the guide body and the plurality of punching tools.

11. The multiple tool as claimed in claim 10, wherein the inspection device has a punch disk mounted in such a way as to be axially displaceable in the guide body, with the plurality of punching tools being mounted in such a way as to be axially displaceable relative to said punch disk, and that the plurality of punching tools each have a punching tool collar interacting with the punch disk in a positively locking manner so as to limit the displaceability of the plurality of punching tools relative to the punch disk in the punching direction.

12. The multiple tool as claimed in claim 10, wherein the inspection device has at least one inspection spring member, which applies a force to the plurality of punching tools that is oriented counter to the punching direction.

13. The multiple tool as claimed in claim 12, wherein the at least one inspection spring member has a spring rate, which is between 0.1 N/mm and 5 N/mm.

14. The multiple tool as claimed in claim 13, wherein the at least one inspection spring member has a spring rate, which is between 0.2 N/mm and 1.0 N/mm.

15. The multiple tool as claimed in claim 12, wherein the at least one inspection spring member is formed with a radial spacing from the tool longitudinal axis.

* * * * *